United States Patent [19]

Leonhard et al.

[11] Patent Number: 4,853,007

[45] Date of Patent: Aug. 1, 1989

[54] SOOT RESERVOIR FOR AN EXHAUST GAS SCRUBBING SYSTEM FOR AN INTERNAL COMBUSTION ENGINE

[75] Inventors: Rolf Leonhard, Schwieberdingen; Peter Schütz, Herdecke, both of Fed. Rep. of Germany

[73] Assignee: Robert Bosch GmbH, Stuttgart, Fed. Rep. of Germany

[21] Appl. No.: 236,708

[22] Filed: Aug. 26, 1988

[30] Foreign Application Priority Data

Sep. 17, 1987 [DE] Fed. Rep. of Germany ..... 3731233

[51] Int. Cl.[4] ..... F01N 3/02

[52] U.S. Cl. ..... 55/337; 55/424; 55/429; 55/DIG. 30; 60/311; 100/210; 100/295

[58] Field of Search ..... 55/337, 424, 425, 429, 55/DIG. 30; 60/311; 100/65, 210, 295; 126/280

[56] References Cited

U.S. PATENT DOCUMENTS

| | | | |
|---|---|---|---|
| 4,217,118 | 8/1980 | Kopf et al. | 55/424 |
| 4,452,040 | 6/1984 | Kobashi | 60/311 |
| 4,622,051 | 11/1986 | Polach et al. | 55/417 |
| 4,649,703 | 3/1987 | Dettling et al. | 60/275 |

FOREIGN PATENT DOCUMENTS

| | | | |
|---|---|---|---|
| 408853 | 2/1968 | Australia | 55/337 |
| 192185 | 11/1956 | Austria | 55/429 |

*Primary Examiner*—Jay H. Woo
*Assistant Examiner*—C. Scott Bushey
*Attorney, Agent, or Firm*—Edwin E. Greigg

[57] ABSTRACT

A soot reservoir for an exhaust gas scrubbing system for an internal combustion engine has a housing, having an inlet for introducing a soot-laden carrier flow diverted from the exhaust gas flow and an outlet for the escape of the scrubbed carrier flow, a soot filter disposed between the inlet and outlet for retaining soot particles, and a removable collecting container for receiving the trapped soot. To attain a large storage capacity of the collecting container, a number of compacting balls are placed loosely in it. Hopping and rolling movements of the balls caused by the motion of the vehicle driven by the engine produce a considerable increase in the settled apparent density of the soot deposited in the collecting container. With the same collecting container volume, about 10 times as much soot can be held, when compared with conventional soot reservoirs.

17 Claims, 1 Drawing Sheet

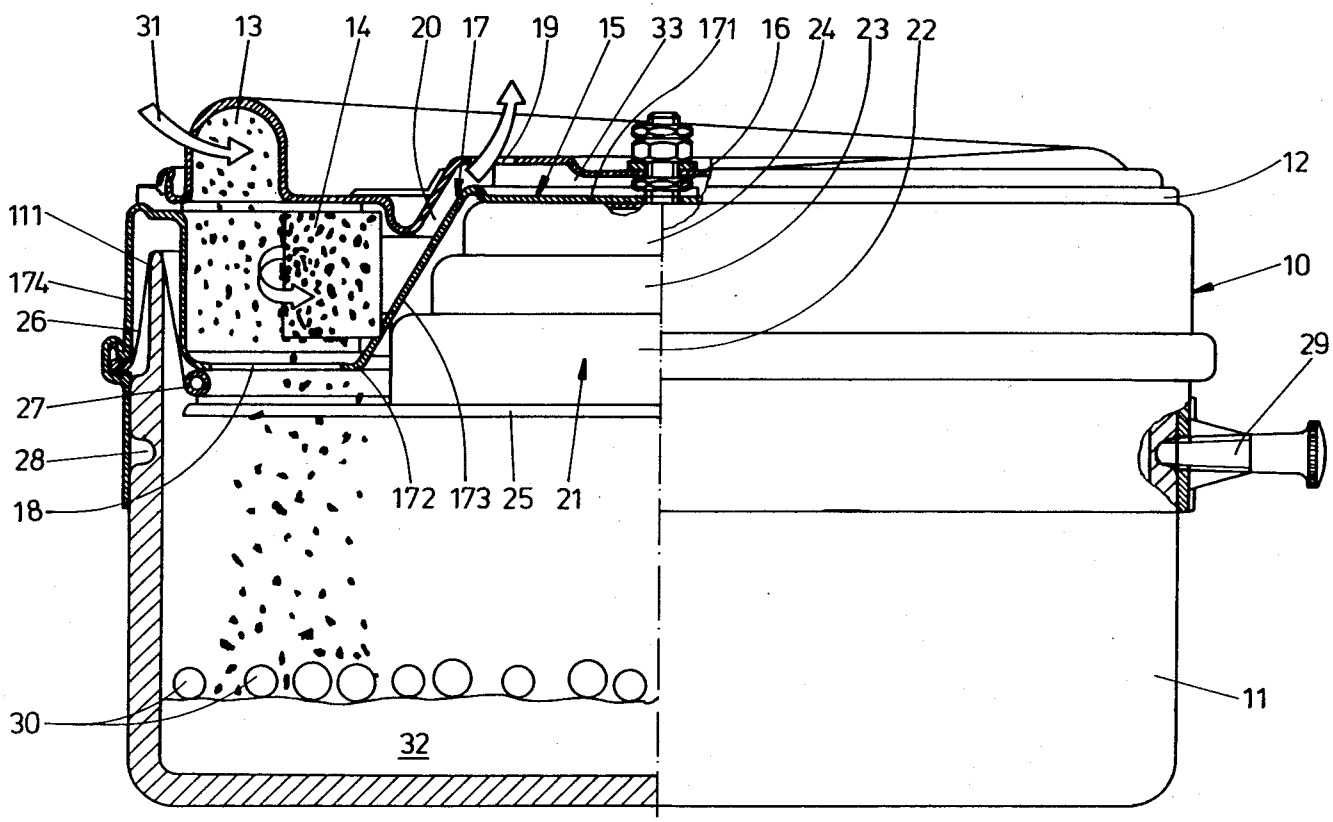
12
10
29
11
22
23
24
16
171
33
15
19
17
20
14
13
31
21
25
173
172
32
111
174
26
27
28
18
30

SOOT RESERVOIR FOR AN EXHAUST GAS SCRUBBING SYSTEM FOR AN INTERNAL COMBUSTION ENGINE

BACKGROUND OF THE INVENTION

The invention relates to a soot reservoir for an exhaust gas scrubbing system for an internal combustion engine, in particular a Diesel engine, of the generic type defined hereinafter.

In a known soot reservoir, or soot collector, for an exhaust gas scrubbing system (German Offenlegungsschrift 34 24 196), a removable collecting bag made of paper is placed in the housing, which is provided with many air outlet openings. The bag functions like the paper bag in vacuum cleaner bags. As soon as the paper bag is full, it is changed. The soot-filled filter bag is then burned, without toxic emissions, in a stationary combustion system. Since the collecting bag cannot filter perfectly, the filter chamber around the collecting bag gets dirty very fast, so that not only is changing the collecting bag a dirty job, but a considerable amount of soot escapes, so that some of the disposal effort is in vain.

A remedy is provided by another known soot reservoir of this generic type (German Offenlegungsschrift 35 02 448), in which the underside of the funnel-like housing, where the cross section is smaller, has a disposal spout, to which a disposal hose can be attached in order to empty the soot reservoir by suction. During operation, the disposal spout is closed with a cap. Here, although emptying the soot reservoir can be done largely without getting dirty, still it must be done at a fixed disposal station.

In both soot reservoirs, the housing must be relatively voluminous, since given an apparent density of the settled soot of approximately 40 grams per liter, the soot reservoir must have a capacity of about 1 liter, for 100 liters of Diesel fuel.

OBJECT AND SUMMARY OF THE INVENTION

The soot reservoir according to the invention has the advantage over the prior art that the settled apparent density of the soot is increased considerably, to between 400 and 600 g/l, by the provision of the compacting balls, which roll and hop about as the vehicle driven by the engine in question moves. This means that the storage capacity of the soot reservoir is increased by a factor of 10, without changing the volume of the housing, or that at a constant reservoir capacity, the housing can be made 10 times smaller. The compacting speed can be adapted to the rate of soot production by varying the number and weight of the compacting balls; it has been proven to be optimal if one-half the bottom of the collecting chamber is covered with steel balls 6 to 20 mm in diameter. The compacting action of the compacting balls is improved still further if the soot reservoir is disposed on parts of the vehicle driven by the engine that are unsprung, as much as possible.

Since the compacting balls are always located on the surface of the compacted soot layer, their location is an indication of how full the collecting chamber of the soot reservoir is; if the compacting balls are embodied as steel balls, the fill level can be monitored via an inductive transducer and indicated to the driver.

The housing is embodied in two parts, one part being a cap with an inlet, outlet and soot filter, and the other part being the collecting container, which can be detached from the cap, so that the container is easy to remove and empty, either by knocking the soot out of the container, or removing it in a paper or plastic bag previously placed there.

To avoid dumping out the compacting balls and having to refill the collecting container with them, the compacting balls, embodied as steel balls, are retained against a perforated plate when the collecting container is removed. At the same time, this plate prevents the steel balls from getting into the soot filter or into the inlet during operation. Little electric current is consumed for retaining the steel balls, so the consumption of electricity is negligible even if the soot reservoir is left open for a relatively long time. By increasing the current briefly, for instance by connecting additional coils to the electromagnet, the steel balls can also be raised and held firmly against the perforated plate even if the collecting container is not yet full, so that the container can be emptied early if desired.

To keep the burden of soot powder as low as possible when the soot reservoir is opened, a further embodiment of the invention has a flexible covering, a so-called screen, of tubular plastic or metal cloth, which automatically closes the underside of the cap when the collecting container is removed and then, when the collecting container is again attached to the cap, uncovers its underside, at least in the vicinity of the soot drop-through opening between the soot filter and the collecting container.

The soot filter, which filters the soot particles out of the soot-laden carrier flow, is hollow-cylindrical and is held in the cap between its inlet and outlet. So that the filter will be uniformly subjected to the soot-laden carrier flow, the inlet has a helically extending inlet spout, which discharges at a tangent to the soot filter. Generally, a flow of the carrier flow through the soot filter from the outside in is provided; however, the soot-laden carrier flow can also be made to flow in the opposite direction, so that the outside diameter of the housing can be reduced. The carrier gas, scrubbed of soot, emerges via outlet openings on the face end of the cap, inside the region encompassed by the soot filter. If the flow of carrier gas is in the opposite direction, then the outlet openings are located outside the region encompassed by the soot filter, and the helical inlet discharges at a tangent on the interior of the soot filter.

The invention will be better understood and further objects and advantages thereof will become more apparent from the ensuing detailed description of a preferred embodiment taken in conjunction with the drawing.

BRIEF DESCRIPTION OF THE DRAWING

The single drawing FIGURE is a side view of a soot reservoir according to the invention, of which one-half is seen in longitudinal section.

DESCRIPTION OF THE PREFERRED EMBODIMENT

The soot reservoir or soot collector shown in longitudinal section and in a side view in the drawing serves to remove soot from exhaust gas scrubbing systems in motor vehicles equipped with Diesel engines. The term "soot" is used here as a synonym for all the solid particles contained in the exhaust gas of the engine. The soot reservoir is connected in a known manner to the particular outlet of a so-called soot shunt of the exhaust gas scrubbing system that carries a flow of exhaust gas, also called a carrier flow, that because of enrichment is heavily laden with soot. The carrier flow makes up approximately 1% of the total exhaust gas of the engine. The structure and operation of a soot shunt, which comprises an electric filter and a centrifugal separator or cyclone, located downstream of the electric filter in the flow of exhaust gas, are described in German Offenglegungsschrift 34 24 196 or German Offenlegungsschrift 35 02 448.

The soot reservoir has a two-part housing 10, comprising a soot collecting container 11 and a cap 12 fitting over it. The cap 12 has a helically extending inlet spout 13, intended for connection with the corresponding outlet of the soot shunt, at the outlet of the cyclone. A hollow-cylindrical soot filter 14 of relatively large diameter and relatively short axial length is retained on the underside of the cap 12. The retention is effected via a rotationally symmetrical holder 15, which is screwed centrally to the cap 12. The holder 15 is embodied as a rotationally symmetrical tub 17, the bottom 171 of which extends parallel to the cap 12, spaced slightly apart from it, forming a gap space 33, and is secured to the cap 12 via a spacer bolt 16. The tub bottom 171 merges integrally with a side wall 173 extending obliquely to the outside and then merges with an approximately horizontally extending circular-annular tub rim 172 projecting outwardly away from the side wall 173, and finally ends at an encompassing groove 174, the U-shaped cross section of which opens to the bottom, the opening of the U being located in approximately the same plane as the tub rim 172. The tub rim 172 is provided with openings 18 in the shape of annular segments, which are so large that of the tub rim 172, only narrow, radially extending webs of material remain. Between the tub rim 172 and the cap 12, the hollow-cylindrical soot filter 14 is fastened, with its outer circumference being maintained at a certain distance apart from the inner rim of the groove 174. The inlet spout 13 discharges radially into this intervening space at the outer circumference of the soot filter 14. The soot-laden carrier flow entering (arrow 31) via the inlet spout 13 flows radially through the lamella-like cylindrical wall of the soot filter 14 and after that enters a flow conduit 20, which extends between the side wall 173 of the tub 17 and the cap 12, as far as the gap 33 between the tub bottom 171 and the cap 12. In the vicinity of the gap 33, the cap 12 has outlet openings 19, by way of which the carrier flow, now freed of soot, then emerges. The outlet openings 19 are distributed in a circle at equal intervals over the cap 12. When the layer of soot deposited at the outer circumference of the soot filter 14 reaches a certain thickness, the soot drops downward, through the openings 18, into the collecting container 11.

An electromagnet 21, of which a primary coil 22 and two additional coils 23, 24 of the exciter winding are visible, is disposed in the interior, defined by the side wall 173 and the tub bottom 171, of the tub 17. The additional coils 23, 24 can be connected to the primary coil 22 arbitrarily, to increase the magnetic force of the electromagnet 21. A perforated or slit plate 25 which is firmly joined to the cap 12 and covers the entire inside cross section of the collecting container 11, is disposed on the underside of the electromagnet 21. A screen 26 of foraminous material is disposed between the plate 25 and the horizontally extending tub rim 172; the screen 26 automatically pulls up over the tub rim 172 when the collecting container 11 is removed, thus preventing the escape of soot through the openings 18 in the tub rim 172 when the collecting container 11 has been removed. This screen 26 comprises a tubular metal or plastic cloth and a spiral spring 27, disposed coaxially with the primary coil 22 of the electromagnet 21. One tube end of the screen 26 is fixed to the outer rim of the groove 174, for example by being crimped over it, while the other tube end of the screen 26 is connected to the outer rim of the round spiral spring 27. The tubular length of the screen 26 is approximately equal to the distance between the point where the screen 26 is fastened to the groove and the transition between the tub rim 172 and the side wall 173 of the tub 17. Upon insertion into the groove 174, the rim 111 of the collecting container 11 oriented toward the cap 12 meets the screen 26, pushing it into the depth of the groove 174. The axial insertion depth of the rim 111 of the collecting container 11 is set such that when the collecting container 11 is properly mounted, the spiral spring 27 is spread apart in such a way that its outer edge rests approximately directly on the inner rim of the groove 174, causing the screen 26 to uncover the tub rim 172 and hence the openings 18 completely.

In the vicinity of the groove 174, the collecting container 11 has beads 28 distributed uniformly over its outer circumference, which are form-fittingly engaged by resilient index bolts 29 that pass from the outside through the outer rim of the groove 174, the outer rim being extended past the crimped portion. As a result, the collecting container 11 is held captively on the cap 12 and can be released simply by removing the index bolts 29. Compacting balls 30, which here are embodied as steel balls having a diameter of 6 to 20 mm, are located inside the collecting container 11. The number of steel balls is selected such that they cover approximately 50% of the bottom surface area, or inside cross section, of the collecting container 11.

The mode of operation of the soot reservoir as described is as follows:

Via the inlet spout 13, the soot-laden carrier flow leaving the soot shunt arrives tangentially at the outer circumference of the soot filter 14 and flows through it from the outside inward, in the course of which the soot particles are deposited on the lamellae of the soot filter 14. The carrier flow, now freed of soot, flows through the air guide conduit 20 to reach the outlet openings 19 in the face end of the cap 12, where it emerges, scrubbed, into the atmosphere.

Once a certain thickness of the soot layer on the lamellae of the soot filter 14 is reached, the so-called filter cake detaches and drops through the openings 18 in the tub rim 172 into the collecting container 11. This cleaning of the filter is reinforced by the jarring that occurs as the vehicle is driven, and so plugging up of the soot filter 14 is precluded. As the thickness of the layer 32 increases, the soot is deposited on the bottom of the collecting container 11.

During the motion of the vehicle, the compacting balls 30 execute a rolling and hopping motion, which compacts the settled apparent density of the layer of soot 32 deposited on the bottom of the collecting container 11 to approximately 400 to 600 g/l. As a result, ten times the usual amount of soot can be held in the collecting container 11. The perforated or slit plate 25 prevents the compacting balls 30 from getting into the soot filter 14 or into the inlet spout 13 in the event that the collecting container 11 is relatively full.

Once the collecting container 11 is full of soot, which for instance can be indicated to the driver via an inductive transducer that monitors the location of the compacting balls 30, the container 11 should be removed from the cap, after the index bolts 29 are pulled out. As the rim 111 of the container 11 slides out of the groove 174, the screen 26 is released, and the tensed spiral spring 27 pulls the screen 26 over the tub rim 172, so that the openings 18 are covered in this region, and soot cannot escape downward from the soot filter 14. The collecting container 11 is emptied by knocking out the soot, or by removing a paper or plastic bag that had previously been placed therein. In this process, the open rim of the collecting container 11 pushes the screen 6 farther down into the groove 174, and spreads the spiral spring 27 apart, tensing it, until the screen 26 again uncovers the openings 18. As soon as the index bolts 29 snap into the beads 28, the container 11 is secured on the cap 12 once again.

To avoid loss of the compacting balls 30 when the collecting container 11 is emptied, the electromagnet 21 is switched on before the container 11 is removed. The compacting balls 30, which always rest on the top of the soot layer 32 and when the collecting container 11 is full are already pressed quite tightly against the plate 25, are electromagnetically attracted to the plate 25 and held firmly there. The collecting container 11 is now free of compacting balls 30 and can be emptied. If the collecting container is to be emptied prematurely, that is, before its maximum fill level has been reached, then in addition to the primary coil 22, the additional coils 23, 24 should be switched on as well. This makes the magnetic force strong enough that even compacting balls 30 located near the bottom of the container 11 will be raised to the plate 25 and firmly held there. The additional coils 23, 24 can then be switched off again, because the primary coil 22 generates a sufficient retaining force. Since the power required to generate the retaining force is low, the energy requirement is also low, even if the soot reservior is open for a relatively long period.

To improve the cleaning of the soot filter 14, an operation known as pressure thrust cleaning can be used, in which thrusts of compressed air are periodically introduced into the interior of the soot filter 14. The compressed air flows from the inside out through the soot filter 14 and blows soot from the soot filter 14.

To make the job of cleaning the collecting container fairly clean, a soot collecting bag in which the soot 32 is received can also be placed in the container. The open soot collecting bag rests on the walls of the collecting container 11. A cord is threaded through its open rim and can be used to draw the edge of the bag completely closed, in order to close the soot collecting bag. In this case, the collecting container 11 can be set down halfway up in its guides on the cap 12, before being taken completely off the cap 12. This intermediate position of the collecting container 11 makes it possible to handle the collecting bag, and in particular to close it by pulling its cord tight, without soiling anything. Once the soot collecting bag is closed, the collecting container is removed completely, and the soot collecting bag is removed from the collecting container 11.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A soot reservior for an exhaust gas scrubbing system of an internal combustion engine, in particular a Diesel engine, comprising a housing having an inlet for introducing a soot-laden carrier flow diverted from a exhaust gas flow and an outlet for escape of the scrubbed carrier flow, a soot filter disposed in said housing between the inlet and the outlet, a collecting chamber disposed below the soot filter to receive the soot separated by the filter, and a plurality of compacting ball means (30) disposed loosely in the collecting chamber for densifying the collected soot (11).

2. A soot reservoir as defined by claim 1, wherein the compacting ball means (30) comprise steel balls having a diameter of from 6 to 20 mm and that a sufficient number of said steel balls are provided to cover approximately 50% of the inside cross-sectional area of the collecting chamber (11).

3. A soot reservoir as defined by claim 1, wherein the housing (10) comprises at least two parts including, a cap having an underside (12), said cap contains the inlet (13), the outlet (19), and the soot filter (14), and a cup-shaped collecting container (11) arranged to surround the collecting chamber, the container (11) further being detachably retained on the cap (12), completely covering the underside thereof.

4. A soot reservoir as defined by claim 3, wherein the collecting container (11) has an opening oriented toward the soot filter (14) that is covered by means of a perforated or slit plate (25), which is retained on the cap (12).

5. A soot reservoir as defined by claim 4, wherein the cap further comprises an electromagnet (21) which is switched on at least upon the removal of the collecting container (11) from the cap (12).

6. A soot reservoir as defined by claim 3, wherein the soot filter (14) comprises a flat hollow cylinder disposed coaxially within the cap (12) said filter being located adjacent an end face of said cap.

7. A soot reservoir as defined by claim 6, wherein the inlet further comprises a helically extending inlet spout (13) discharging tangentially adjacent the outer circumference of the hollow-cylindrical soot filter (14) and the outlet further comprises a plurality of outlet holes (19) distributed over the end face of the cap (12).

8. A soot reservoir as defined by claim 7, wherein the outlet holes (19) are disposed in the cap (12) radially inside the region of the cap emcompassed by the radial extent of the soot filter (14).

9. A soot reservoir as defined by claim 3, wherein a soot filter support means includes drop through openings arranged between said filter and said collecting container, and a flexible screen disposed between said support means and said collecting chamber, whereby when the collecting container is removed the screen (26) is automatically pulled over the drop through openings.

10. A soot reservoir as defined by claim 4, wherein a soot filter support means includes drop through openings arranged between said filter and said collecting container, and a flexible screen disposed between said support means and said collecting chamber, whereby when the collecting container is removed the screen (26) is automatically pulled over the drop through openings.

11. A soot reservoir as defined by claim 5, wherein a soot filter support means includes drop through openings arranged between said filter and said collecting container, and a flexible screen disposed between said support means and said collecting chamber, whereby when the collecting container is removed the screen (26) is automatically pulled over the drop through openings.

12. A soot reservoir as defined by claim 6, wherein a soot filter support means includes drop through openings arranged between said filter and said collecting container, and a flexible screen disposed between said support means and said collecting chamber, whereby when the collecting container is removed the screen (26) is automatically pulled over the drop through openings.

13. A soot reservoir as defined by claim 7, wherein a soot filter support means includes drop through openings arranged between said filter and said collecting container, and a flexible screen disposed between said support means and said collecting chamber, whereby when the collecting container is removed the screen (26) is automatically pulled over the drop through openings.

14. A soot reservoir as defined by claim 8, wherein a soot filter support means includes drop through openings arranged between said collecting container, and a flexible screen disposed between said support means and said collecting chamber, whereby when the collecting container is removed the screen (26) is automatically pulled over the drop through openings.

15. A soot reservoir as defined by claim 9, wherein the screen (26) comprises a foraminous circular sheet having a central aperture the outside diameter of which is approximately equal to the diameter of a rim of the cap (12) and the radial extent of which is approximately equivalent to the radial spacing between the inner edge of the soot drop-through openings (18) and the cap rim, and an outer edge of the circular sheet being secured firmly to the cap rim and an inner edge being secured to an outer edge of a spiral spring (27), the axis of which is in alignment with the housing axis.

16. A soot reservoir as defined by claim 15, wherein the collecting container (11) is insertable with its open face end into the cap (12), taking the screen with it, to an axial depth such that the outer edge of the spiral spring (27) is spread apart at least to an outer diameter of the soot drop-through openings (18).

17. A soot reservoir as defined by claim 11, wherein the collecting container (11) has depressions (28) spacedly arranged on its circumference and into which index bolts (29), carried by the cap (12) are received.

* * * * *